United States Patent [19]

Bader

[11] Patent Number: 4,588,079

[45] **Date of Patent: * May 13, 1986**

[54] COUPON AND COVER FOR MULTIPLE UNIT CONTAINER PACKAGES

[75] Inventor: James S. Bader, Lakewood, Colo.

[73] Assignee: Adolph Coors Company, Golden, Colo.

[ * ] Notice: The portion of the term of this patent subsequent to Jan. 3, 2001 has been disclaimed.

[21] Appl. No.: 552,606

[22] Filed: Nov. 17, 1983

Related U.S. Application Data

[63] Continuation-in-part of Ser. No. 292,811, Aug. 14, 1981, Pat. No. 4,423,810.

[51] Int. Cl.[4] ..... B65D 71/00

[52] U.S. Cl. ..... 206/158; 206/159; 206/161

[58] Field of Search ..... 206/159, 160, 161, 139, 206/141, 145–158

[56] References Cited

U.S. PATENT DOCUMENTS

| | | | |
|---|---|---|---|
| 3,410,398 | 11/1968 | Arneson | 206/159 |
| 3,434,592 | 3/1969 | Moore et al. | 206/159 |
| 3,640,448 | 2/1972 | Wood | 206/158 |
| 4,216,859 | 8/1980 | Bader et al. | 206/159 |
| 4,328,891 | 5/1982 | Elward | 206/158 |
| 4,423,810 | 1/1984 | Bader | 206/158 |

*Primary Examiner*—Joseph Man-Fu Moy
*Attorney, Agent, or Firm*—Klaas & Law

[57] ABSTRACT

A cover for multiple unit container packages of containers secured by at least one clip device having a central opening wherein the cover includes a tab device extending through the clip opening and engaging clip bottom surfaces to hold the cover in place on the top of the multiple unit package.

16 Claims, 9 Drawing Figures

COUPON AND COVER FOR MULTIPLE UNIT CONTAINER PACKAGES

CROSS-REFERENCE TO RELATED APPLICATIONS

The present application comprises a continuation-in-part of U.S. application Ser. No. 292,811 filed Aug. 14, 1981, now U.S. Pat. No. 4,423,810 by James S. Bader entitled "Cover for Multiple Unit Container Packages".

BACKGROUND AND SUMMARY

This invention relates to apparatus for and methods of providing an attachment for multiple unit packages of containers generally known as "four packs", "six packs", "eight packs" or "twelve packs", or the like. The attachment may be used as a protective cover and/or an advertising device and/or coupon.

The invention is useful in connection with multiple unit container packages which are held together by one or more clip devices of the type described in U.S. Pat. No. 4,216,859 issued to Bader, et al. on Aug. 12, 1982 entitled "Can Clip and Package" and U.S. application Ser. No. 524,129 filed Aug. 17, 1983 by James S. Bader entitled "Improved Can Clip and Multiple Container Package" the disclosure of which are both specifically incorporated herein by reference.

The following prior granted United States patents disclose various related cover and/or package concepts: Suffern, U.S. Pat. No. 4,191,290; Poupitch, U.S. Pat. No. 2,923,405; Poupitch, U.S. Pat. No. 2,936,070; Poupitch, U.S. Pat. No. 3,331,500; Poupitch, U.S. Pat. No. 3,628,823; Poupitch, U.S. Pat. No. 3,628,823; and, Arneson, U.S. Pat. No. 3,410,394.

In general, the method of the present invention comprises assembly of a multiple container unit by inserting and attaching one or more clips between and to the rims of four or six or eight or ten or twelve, etc. containers. Then a precut and pre-scored flat preassembly cover means of predetermined construction is placed on the end surfaces of the containers joined by the clips in predetermined alignment therewith. The cover means may comprise a sheet having printed advertising materials on the upper surface or lower surface, and/or a coupon attached to the bottom surface, or the coupon may form a part of, or the entire portion of the sheet. Consequently, the cover means may, or may not function to cover all of, or a portion of, the end surfaces of the containers. Central portions of the sheet are retainably associated with portions of the clips. The sheet may be provided with edge panel portions which are retainably associated with side surface portions of the containers adjacent the joined end surfaces, or the sheet may cover only a portion of the top end surfaces and may serve as a coupon, or a portion thereof serve as a coupon.

The flat cover sheet central portions are associated with portions of the clips by resiliently depressing integral tab portions into retaining engagement with the clip portions. The flat cover sheet edge panel portions are associated with side portions of the containers by resilient deflection into conforming engagement therewith and adhesively connecting adjacent ones of the edge portions.

In one embodiment, illustrating the use of the invention as a protective cover, the flat cover sheet comprises one piece of material, such as paper and/or plastic, having a central body portion with peripheral edge panels centrally connected thereto by cut and/or score lines to enable folding along the cut-and-score lines to an assembled position extending at substantially right angles relative to the central body portion. The edge panels along each side of the central body portion are separated from one another by slits adjacent the corners of the flat cover sheet to enable relative displacement therebetween. Slots are provided adjacent each corner to separate and space the edge panels from the central body portion. The slots are defined by a curved edge surface of the body portion, which has a radius of curvature approximately equal to the radius of curvature of the end portion of the container to be located in juxtaposition thereto, and a pair of intersecting straight edge panel portions aligned with the score lines. The flat pre-assembly cover sheet further comprises retaining tab means associated with the central body portion for movement from the plane of the flat cover sheet toward the clips and into resilient retaining engagement therewith. The retaining tab means are aligned with the openings in the clips whereby the multiple container unit may be carried by insertion of a person's thumb and finger after assembly of the package. The retaining tab means is of generally T-shaped peripheral configuration with a stem portion integrally attached to the central body portion of the cover along a cut-and-score fold line and a laterally elongated flap portion integrally connected to the stem portion and severed from the central body portion by a cut line. The flap portion is provided with a pair of inclined score lines to provide a pair of resilient deflectable ear portions which, upon movement of the tab portion into the central circular opening of the clip, are locatable therebeneath and retainably engageable therewith. The tab portions or a part thereof fold in a direction toward each other to provide finger protection from the molded clip. The peripheral edge panels may, or may not, be included and the configuration of the periphery of the cover sheet may be the same as, or smaller than, the periphery of the package of containers. In addition, the configuration of the periphery of the cover sheet may be other than essentially polygonal.

BRIEF DESCRIPTION OF DRAWING

Illustrative and presently preferred embodiments of the present invention are shown in the accompanying drawing in which.

DETAILED DESCRIPTION

Figure 1:
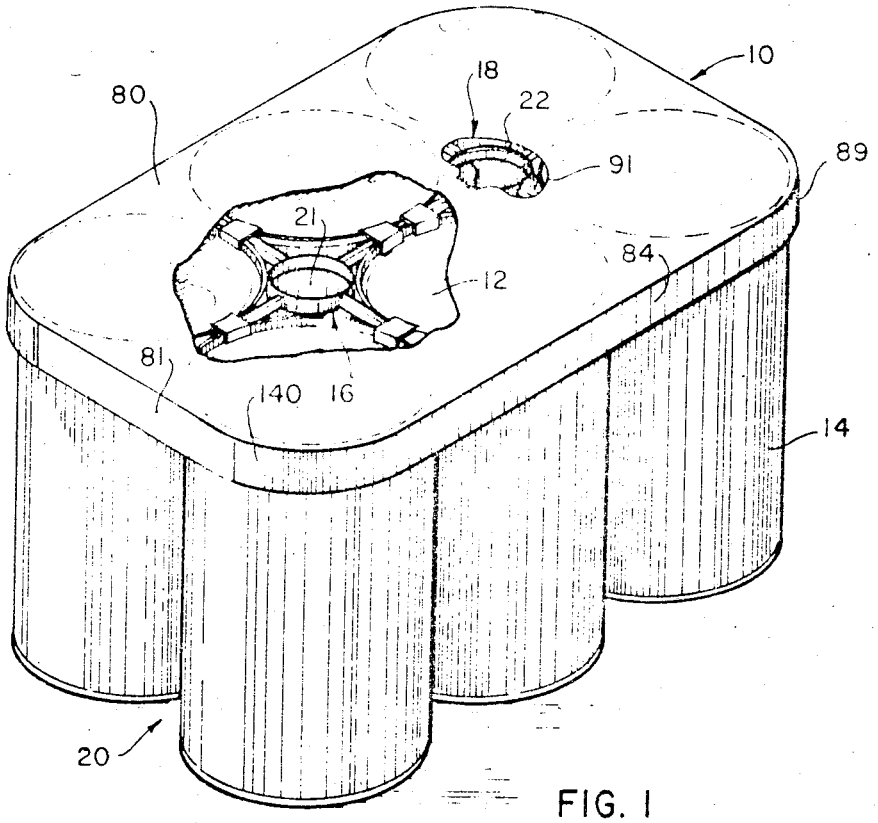
FIG. 1 is a schematic perspective view of a cover sheet member, with a portion broken away, after assembly and mounting on a multiple container package unit.

In general, the invention comprises a cover member 10 made of one piece of paperboard or plastic material which is detachably mounted over the opening end surfaces 12 of a plurality of can-type containers 14 connected by one or more clip members 16, 18 to form a multiple container package unit 20 with finger openings 21, 22 to enable hand carrying of the package unit.

Figure 3:
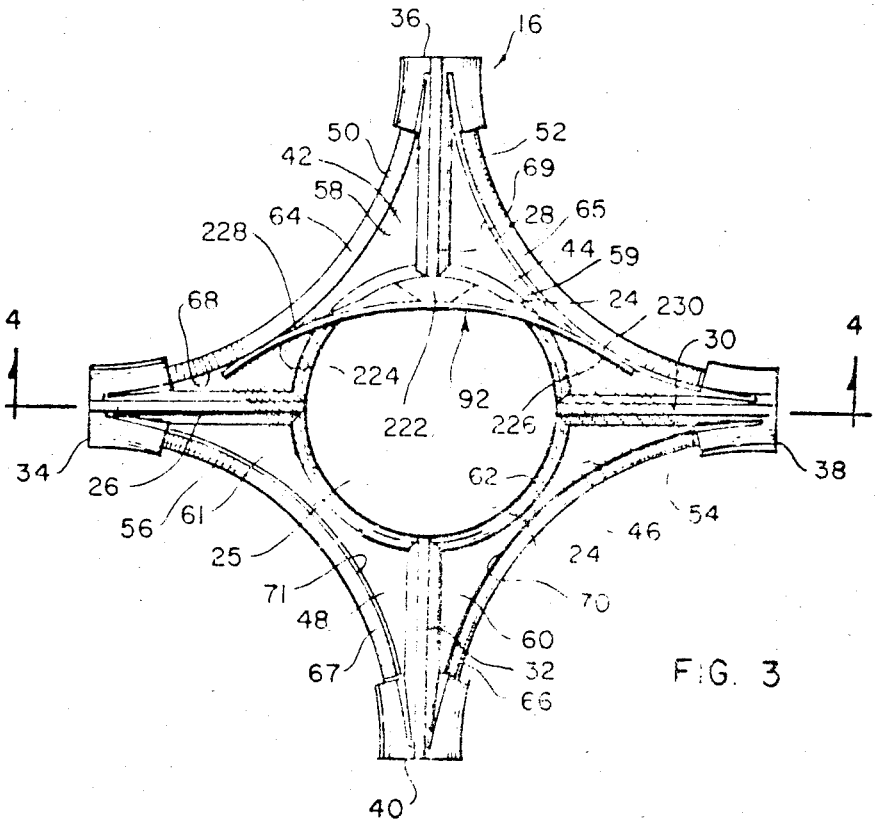
FIG. 3 is an enlarged bottom view of the clip and associated retaining tab means of FIG. 1.
Figure 4:
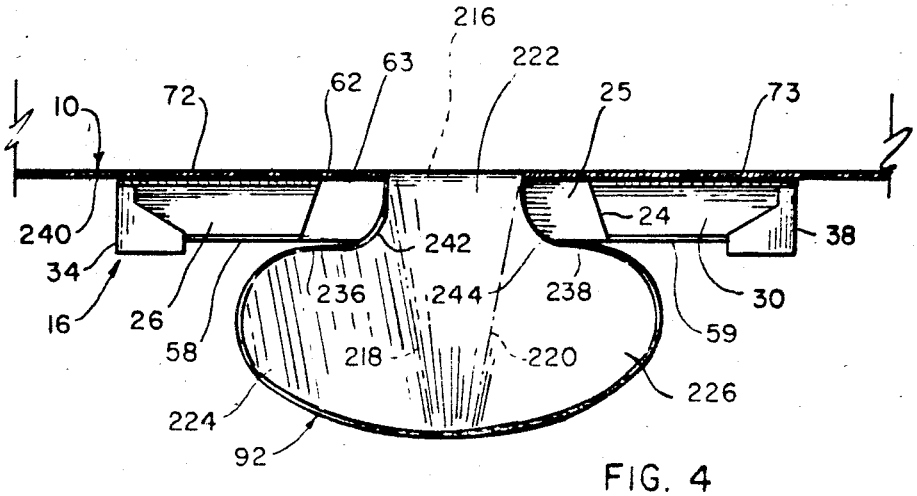
FIG. 4 is a cross-sectional view of the clip and retaining tab means taken along line 4—4 in FIG. 3.

Referring to FIG. 1, each of the clip members 16, 18 are made of one piece of molded plastic material comprising a downwardly outwardly tapered circular inner rim portion 24 defining a finger opening 25, FIG. 3; four equally spaced radially outwardly extending hinge portions 26, 28, 30, 32 terminating in enlarged clip portions 34, 36, 38, 40 which are releasably connectable to the rims of the container ends; and flange portions 42, 44, 46, 48 extending between the rib portions with arcuate concave outer side surfaces 50, 52, 54, 56 adapted to abuttingly receive outer surface portions of the cylindrical side walls of the body portions of the containers. The flange portions 42, 44, 46, 48 have flat coplanar bottom surfaces 58, 59, 60, 61 which intersect the downwardly inwardly tapered inner surface 62 of rim portion 24 along a circular edge 63. Arcuate hook base 64, 65, 66, 67 extend downwardly from the outermost portions of flanges 42, 44, 46, 48 and provide arcuate inner surfaces 68, 69, 70, 71 which intersect bottom surfaces 58, 59, 60, 61. The upper surfaces 72, 73 of each of the rib portions 26, 28, 30, 32 and associated clip portions 34, 36, 38, 40 are coplanar as illustrated in FIG. 4. As shown in FIG. 1, the clip members are mounted in the space defined by and located between groups of four containers arranged in closely spaced relationship with lower side surface portions of the containers in abuttingly engageable relationship to form a multiple container package unit. Other details of construction and usage of the clip members are described in the aforeidentified U.S. Pat. No. 4,216,859 and U.S. application Ser. No. 524,129 filed Aug. 17, 1983.

The cover member 10 comprises a central body portion 80 having a peripheral configuration corresponding to the peripheral configuration of the multiple container package unit so as to fully cover the opening end surfaces of each container with a solid unperforated portion of the cover member. Transversely extending side panel portions 81, 82, 83, 84 are integrally connected to the peripheral portions of the central body portion 80 along score and/or cut fold lines 85, 86, 87, 88; and are connected to form a rim means 89 extending completely around the periphery of the multiple container package unit in closely spaced substantially abutting relationship with surface portions of the cylindrical side walls of each of the containers closely adjacent the opening end portions thereof. Finger receiving openings 90, 91 are provided in the central body portion opposite to and aligned with each of the clip finger openings 21, 22 when integral tab-type retaining means 92, 94 in the central body portion 80 are depressed into the clip finger openings and detachably connected to each of the clip members 16, 18.

Figure 2:
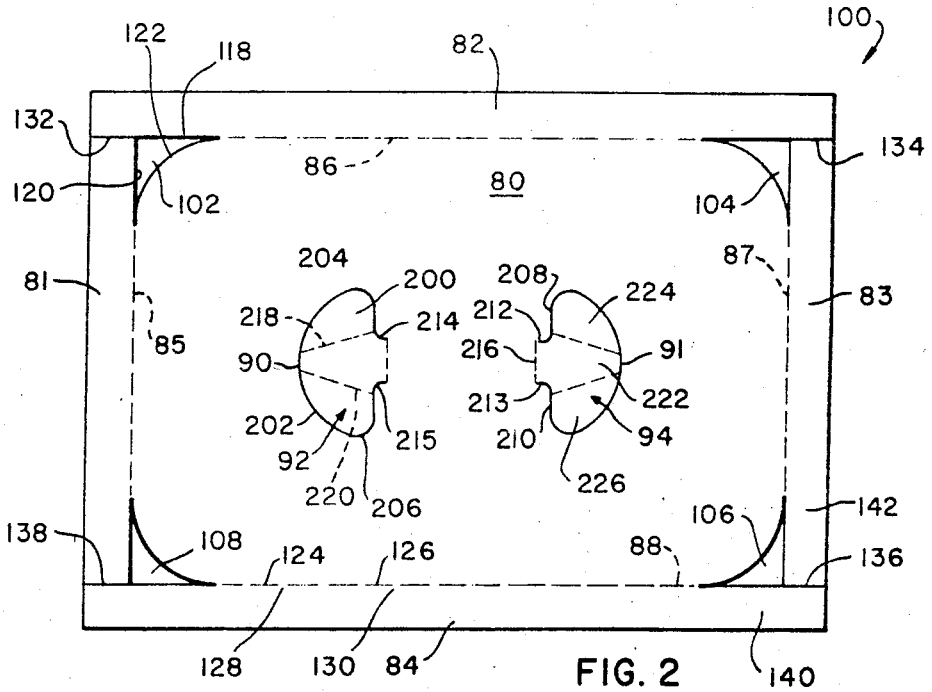
FIG. 2 is a schematic plan view of a flat preassembly cover sheet prior to assembly and mounting as shown in FIG. 1.

The pre-assembly form and construction of cover member 10 prior to being formed about and attached to the multiple container package unit, as shown in FIG. 2, comprises a flat one piece rectangular sheet of material 100 which has been stamp cut, perforated and scored from a larger continuous sheet of material by conventional package manufacturing apparatus and methods. The central body portion 80 is defined by corner cut-out openings 102, 104, 106, 108 and fold lines 85, 86, 87, 88. Each cut-out corner opening comprises transversely extending intersecting straight line edge surfaces 118, 120, which intersect opposite ends of a convexly curved cut line 122, having a radius approximately equal to the outer peripheral radius of the opening end portion of the container, and are aligned with the fold lines 85, 86, 87, 88. In the embodiment of FIG. 2, each fold line comprises regularly spaced slits 124, 126 separated by regularly spaced score lines 128, 130 to define opposite parallel pairs of relatively long and short length elongated rectangular side panel portions 82, 84 and 81, 83, respectively, which are separated from one another by corner slits 132, 134 and 136, 138 aligned with fold lines 86 and 88, respectively. The construction and arrangement is such that each corner comprises a relatively long length tab portion 140 and a relatively short length tab portion 142 adapted to be wrapped into overlapping relationship about the cylindrical side wall of the corner container and fixedly connected by use of layers of adhesive material (not shown) applied to one or the other of the tab portions prior to the wrapping. If desired, the edge panels 81, 82, 83, 84 may be eliminated so that the protective cover has a peripheral configuration the same as body portion 80.

Referring now to FIG. 2, the integral tab-type retaining means 92, 94 comprises a mushroom shaped tab portion 200 defined by a relatively large radius cut line 202; a pair of opposite relatively small radius cut lines 204, 206; a pair of opposite aligned relatively long length straight cut lines 208, 210; a pair of parallel spaced relatively short length cut lines 212, 213 connected to lines 208, 210 by curved cut lines 214, 215; and a scored fold line 216 at the integral connection between the tab portion 200 and the body portion 80. A pair of outward inwardly inclined scored and cut lines 218, 220 divide the tab portion 200 into a central portion 222 and ear portions 224, 226. After the sheet 100 is placed over the multiple container package unit with tab means 92, 94 aligned with clip openings 21, 22, the tab portions 200 are forced downwardly through openings 21, 22 by applying force to the upper surface of central portion 222 by a suitable tool such as a punch (not shown) having a cross-sectional shape enabling movement into the clip openings which causes the ear portions 224, 226 to be resiliently folded toward one another about fold lines 218, 220, a sufficient distance to enable passage through openings 21, 22. The application of both the clip and cover is more fully disclosed in U.S. patent application Ser. No. 501,008 filed June 3, 1983 by James S. Bader et al., entitled "Multiple Container Packaging System" which is specifically incorporated herein by reference and forms a part of this disclosure for all that it discloses. As shown in FIGS. 3 & 4, central portion 222 generally conforms to and is located adjacent the inclined conical surface 62 of rim 24. After the ear portions 224, 226 pass through openings 21, 22. These portions resiliently outwardly expand about fold lines 218, 220, which provide resilient hinge means, and may engage curved surfaces 68, 69, of rim portions 64, 65 at 228, 230. In addition, flat edge upper ear surfaces 236, 238, defined by cut lines 208, 210, abuttingly engage lower surface portions 58, 59 of clip flange portions 42, 44 to detachably hold the cover 10 on the multiple container package unit until and unless removed therefrom by the consumer.

Figure 5:
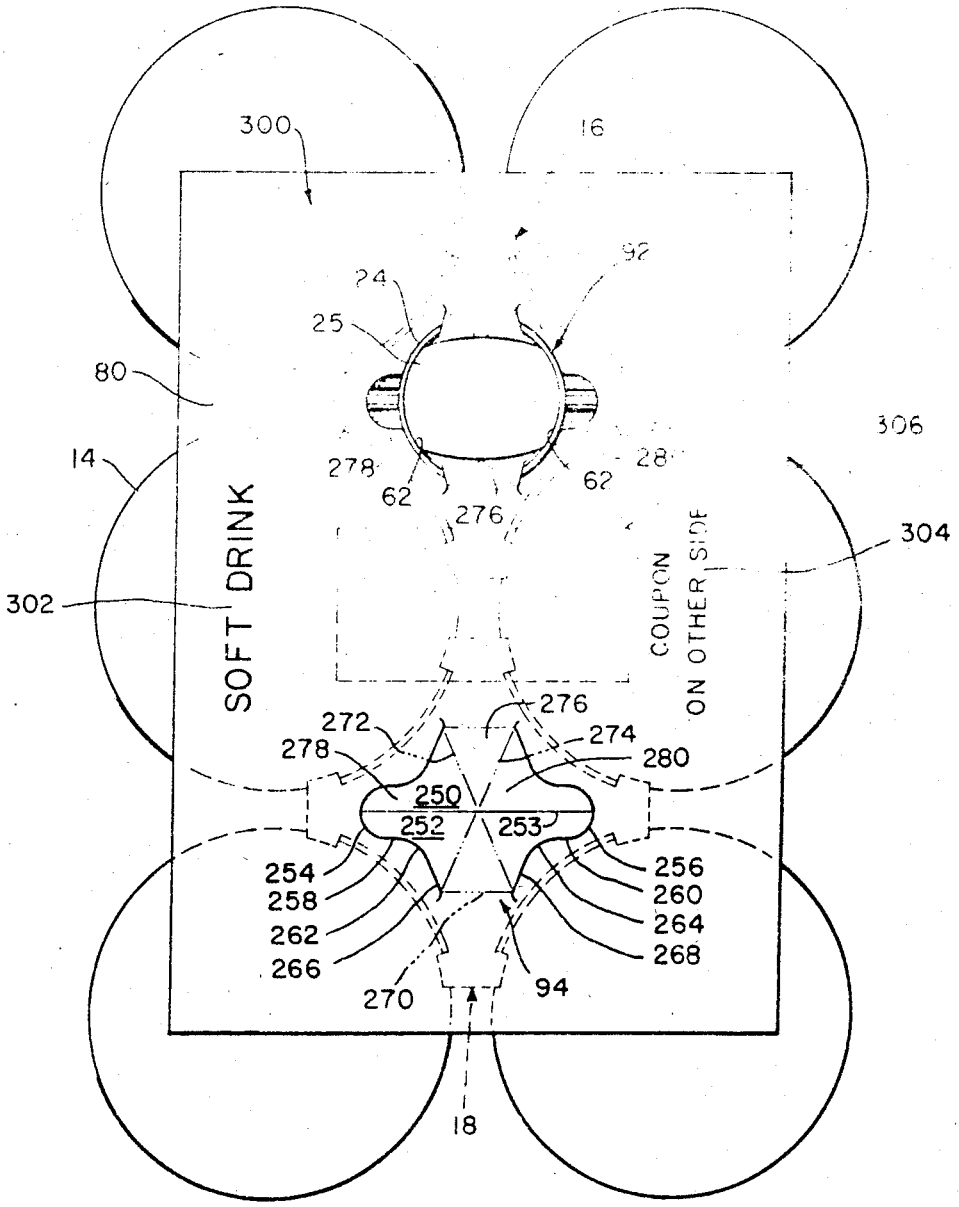
FIG. 5 is a schematic view of another embodiment of a flat cover sheet member having a retaining tab means of a different configuration.

The bottom surface 240 of central body portion 80 abuts the coplanar flat upper surfaces 72, 73 of the clips. The curved upper tab edges 242, 244 (defined by cut lines 214, 215) extend across and beneath the circular bottom edge between bottom surfaces 58, 59 and opening side surface 62. The distance between hinge line 216 and surfaces 236, 238 is approximately equal to the distance between clip top surfaces 72, 73 and clip bottom surfaces 58, 59 so as to establish an interference fit therebetween in the assembled position. As shown in FIG. 1, the openings 90, 91, defined by tab portions 200, are slightly larger than the clip openings 21, 22 so as to enable insertion of a finger therethrough to grip the clip with the main body portion of the cover extending over the entire upper opening and surface of the containers adjacent thereto. The upper surface of body portion 80 may be provided with suitable advertising and promotional decorations and information. A coupon may be attached to the bottom surface of body portion 80 as illustrated in FIG. 5 so as to be accessible to the consumer only after the package has been purchased and the cover has been removed. Additionally, a coupon may comprise a portion of body portion 80 for removal along perforation or cut-and-scored lines formed in the body portion 80.

Referring now to FIG. 5, an alternative embodiment of the tab means 92, 94 is shown to comprise a pair of oppositely positioned tab portions 250, 252 of generally truncated bell-shape peripheral configuration separated by a central cut line 253. Each tab portion 250, 252 is defined by opposite laterally outermost curved cut lines 254, 256, laterally outwardly inclined straight cut lines 258, 260, curved cut lines 262, 264, laterally outwardly inclined straight cut lines 266, 268 and a scored fold line 270 providing an integral hinge means connecting the tab portion to central body portion 80. Nicks, i.e. uncut portions, can be employed to hold tab portions 250, 252 attached to body portion 80. A pair of outwardly inwardly inclined converging score fold lines 272, 274 divide the tab portions 250, 252 into a central portion 276 and ear portions 278, 280. After assembly as hereinbefore described, and as illustrated in the upper portion of FIG. 5, the outermost parts of tab ear portions 278, 280 of both tab portions 250, 252 are located beneath the associated clips 16, 18 in abutting engagement with clip flange bottom portions or clip bottom surfaces 58, 59, 60, 61 and may engage clip rib side surfaces 68, 69, 70, 71 as previously described. Again, central tab portions 276 extend downwardly through clip openings 25 in juxtaposition to downwardly outwardly inclined conical side surfaces 62 of the clip openings.

As shown in FIG. 5, the invention may be used as an advertising and promotion cover sheet 300 which is of smaller size than the upper peripheral surface of the container package and not intended to be used to protect the upper opening end surfaces of the containers. While the peripheral configuration of cover sheet 300 is shown to be rectangular, it is to be understood that it may have any peripheral configuration such as that of a basketball or football with corresponding artwork to be used for a special promotion of an event, a holiday or the like. Suitable advertising and promotional printed matter 302, 304 may be provided on the upper surface and a coupon 306 may be attached to the bottom surface between tab means 92, 94 or may form a part of, or the entire portion of the cover sheet 300. Again, if a portion of cover sheet 300 comprises a coupon, perforations may be formed in the cover sheet 300 for removal of the coupon.

In order to assemble the multiple container package unit of FIGS. 1 and 5, individual containers are arranged in groups of four or six or eight, etc. Clip members are then inserted into the cavities between the containers and attached to the rim portions of the opening end portions of the containers. Then a precut-and-scored flat sheet member 100 is placed over the opening end portions of the containers with the periphery of the central body portion of member 100 aligned with the periphery of the multiple container unit. The central body portion of member 100 is supported on the rim portions of the containers and tab means 92, 94 are aligned with clip finger openings 21, 22. Panel portions 81, 82, 83, 84 extend outwardly beyond the periphery of the multiple container unit with cut-and-score lines 85, 86, 87, 88 located along the periphery thereof. The tab means 92, 94 are then displaced downwardly into retaining engagement with the clip members as hereinbefore described. An adhesive material is applied to the bottom surfaces of panel end portions 140 or top of end portion 142. End panel portions 81, 83 and side panel portions 82, 84 are folded downwardly about fold lines 85, 87, and 86, 88, respectively, into engagement with the outermost surfaces of the body portions of the adjacent containers. Panel end portions 142 and 140 are then wrapped about the outermost side surfaces of the corner containers with shorter length end portions 142 first engaging the container side surfaces and longer length end portions 140 then being wrapped about the container side surfaces and over end portions 142. Adhesive material fixedly connects the end portions 140 and 142 to secure the panel portions beneath the chimes of the opening end of the container. Application of the cover is more fully disclosed in the above identified U.S. patent application Ser. No. 501,008 filed June 3, 1983 by James S. Bader et al.

The cover 10 is formed on and detachably secured to the multiple container unit solely by integral tab means 92, 94 connected only to the clip members 16, 18 which provide sufficient strength to enable the cover member 10 to be retained on the multiple container unit throughout subsequent handling and storage during distribution to the consumer while enabling the cover to be easily removed by the consumer. The cover member serves to protect the opening end portions of the container from possible contamination and also enables the use of preprinted advertising and identification indicia on the upper surface of the cover.

Figure 6:
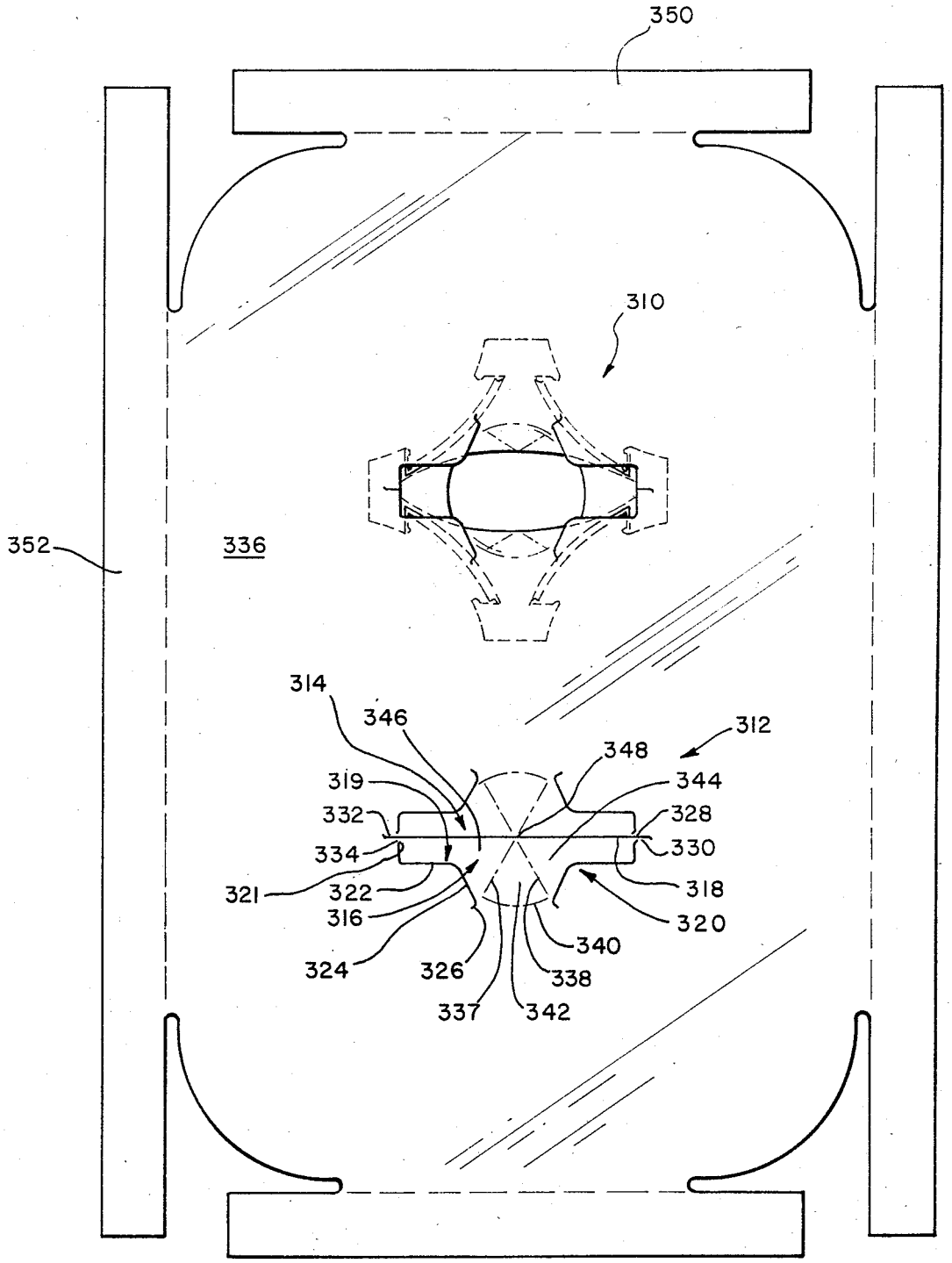
FIG. 6 is a schematic plan view of an additional embodiment of a flat cover sheet member.

FIG. 6 discloses an alternative embodiment utilizing a slightly different configuration of the embodiment illustrated in FIG. 5. As shown in FIG. 6, tab means 310, 312 comprises a pair of oppositely positioned tab portions 314, 316 of a generally rectangular shaped peripheral configuration separated by a central cut line 318. Each tab portion 314, 316 is defined by a pair of substantially identical opposing cut lines 319, 320 defined by lateral cut line 321, transverse cut line 322, diagonal cut line 324 and hook cut line 326. Hook cut line 326 has a curved configuration which functions to prevent tearing of cover sheet 336 upon separation of tab portions 314, 316 from cover sheet 336. Between central cutline 318 and opposing lines 319, 320 portions of cover sheet 336 remain uncut to hold tab portions 314, 316 in place prior to assembly with the clip device. The uncut portions are referred to as nicks. Nicks 328, 330, 332, 334 hold the tab portions in place and allow the covers to be handled and stacked in an assembly line process without interference from adjacent covers. Additionally, the nicks are sufficiently small to prevent tearing of cover sheet 336 upon separation of tab portions 314, 316. Score lines 337, 338 provide resilient fold lines between central portion 342 and ear portions 344, 346 of tab portion 316. Score line 340 provides a fold line between tab portion 316 and cover sheet 336 to allow tab portion 316 to be displaced from cover sheet 336 and disposed in the central opening of the clip such that tab portion 316 hinges along score line 340.

Score line 340 is curved to fit the curved surface of a plunger (not shown) used to displace tab portions 314, 316 from cover sheet 336, such as disclosed in the above referenced U.S. patent application Ser. No. 501,008 filed June 3, 1983 by James S. Bader et al. The plunger functions to pinch tab portions 314, 316 against the generally circular surface of the central opening in the clip during insertion of the plunger such that the tab portions 314, 316 fold along the curved configuration of score line 340. The tab portions 314, 316 become properly seated in the clip device as a result of the displacement of the tab portions from cover sheet 336 at score lines 340 and the folding and resilient expansion of tab portions 314, 316 along resilient fold lines 337, 338. Also, the plunger has a generally cone shaped configuration which matches the configuration of the tab portions upon displacement along fold lines 340 and diagonal cut lines 324 to insure proper placement to tab portions 314, 316 on the bottom surface of the clip.

In operation, tab means are disposed in the clip in the manner illustrated by tab means 310, FIG. 6 such as disclosed in the above referenced U.S. patent application Ser. No. 501,008 filed June 3, 1983 by James S. Bader et al. Briefly, cover sheet 336 is disposed over the multiple container package and tab means 310, 312 are positioned adjacent clips disposed on the multiple container package. As both the cover sheet 336 and multiple container package are moved along an assembly line, plungers apply pressure to center location point 348 to displace the tab portions in the central opening 21, 22 of the clip means 16, 18. The tab portions 314, 316 separate from cover sheet 336 at nicks 328, 330, 332, 334 upon application of pressure by the plunger at center location 348. The radius of curvature of hook cut lines 326 prevents tearing of cover sheet 336. As tab portions 314, 316 are displaced within central opening 21, 22, tab portions 314, 316 fold along hinge fold line 340 to provide a flexible hinge between cover sheet 336 and tab portions 316. At the same time, ear portions 344, and 346 fold relative to central portion 342 along resilient fold lines 337, 338 to allow insertion of the tab means 316 within the central opening of the clip. Resilient fold lines 337, 338 cause ear portions 344, 346 to resiliently outwardly expand to engage a lower surface portion 58, 59, 60, 61 of the molded clip means such that the ear portions 344, 346 are held in an expanded position in interlocking relationship with the clip means, as illustrated by tab means 310, FIG. 6. The surface of the tab portions adjacent transverse cut line 322 engage the bottom portion 58, 59, 60, 61 of the clip. The ear portions engage the flange portion of the bottom surface of the clip which can comprise either a rib structure or a solid flange, or other suitable bottom portions of the clip, such as the various bottom portions of the clips disclosed in the above referenced U.S. Pat. No. 4,216,859, U.S. patent application No. 524,129 filed Aug. 17, 1983 by James S. Bader, and other suitable clips disclosed by the prior art. The generally rectangular shape of ear portions 314, 316 provide an increased contact area with the bottom of the clip to increase the holding ability of the tab portions. Panel end portions 350, 352 are folded around the multiple container package and adhesively secured to one another, as disclosed in the above referenced U.S. patent application Ser. No. 501,008 filed June 3, 1983 by James S. Bader et al.

Figure 7:
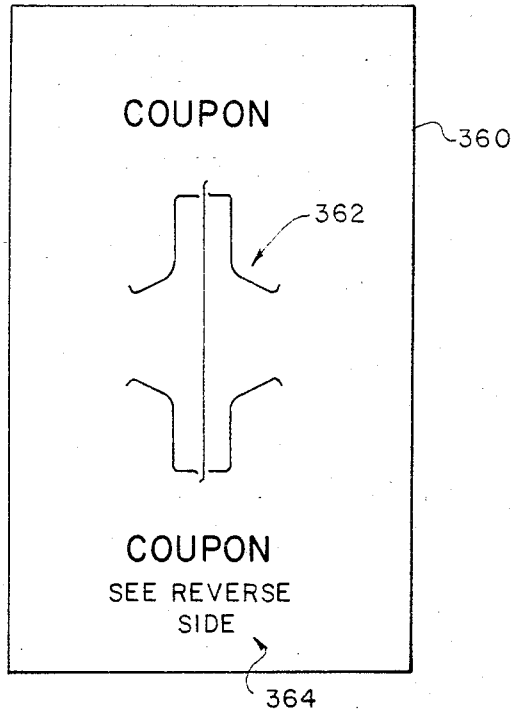
FIG. 7 is a schematic plan view of an additional embodiment of a cover means used as a coupon.

FIG. 7 illustrates a coupon 360 having tab means 362 which couple the coupon 360 to a clip disposed on a group of cans. Coupon information is preferably provided on the reverse side of the coupon but can be placed on either side. Identifying information 364 can identify the article 360 as a coupon and direct the purchaser to the other side of the coupon for coupon identification information. A single tab means 362 is utilized in the coupon of FIG. 7 to attach coupon 360 to the group of containers. The peripheral configuration and decoration of coupon 360 can be used to identify the coupon as an advertising device for a special event such as a sporting event or holiday. For example, the coupon could resemble a baseball, basketball, turkey, Christmas bell, etc. to provide discounts for special sporting events and holiday seasons.

Figure 8:
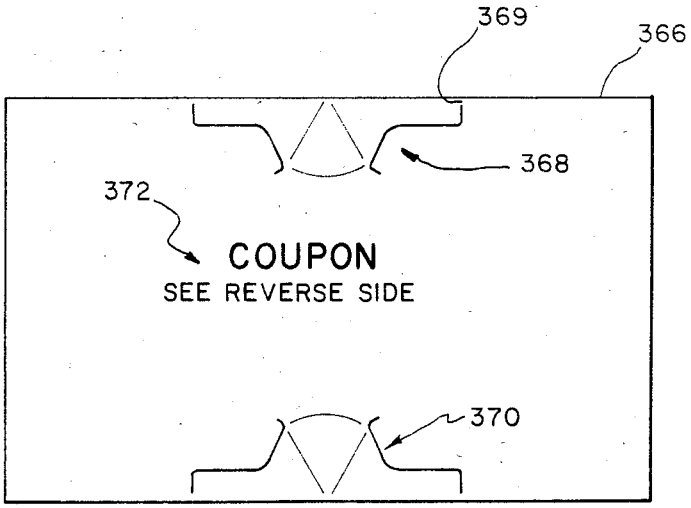
FIG. 8 is a schematic plan view of an additional embodiment of a cover means used as a coupon.

FIG. 8 discloses a coupon 366 having two tab means 368, 370 for attachment to two clip devices which may form, for example, a "six-pack" multiple container configuration. The advantage of the coupon configuration of FIG. 8 which utilizes two tab means 368, 370 is that coupon 366 is attached to the multiple container package in two locations to maintain the coupon in fixed relationship with the clips to resist detachment from the multiple container package by rotational movement. Again, advertising information 372 can be provided on the top surface which refers to the bottom surface of the coupon for details. Nicks 369 comprise uncut portions of the body portion of coupon 366 which function to hold tab means 368, 370 to said body portion prior to assembly with the clip. This aids in stacking and handling of coupon 366.

Figure 9:
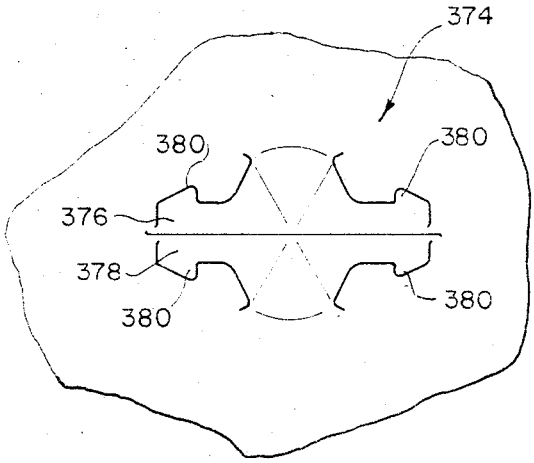
FIG. 9 is a schematic plan view of an alternative embodiment of tab means which can be used in accordance with the present invention.

FIG. 9 comprises a schematic view of a tab means which can be utilized in accordance with any of the embodiments illustrated in FIGS. 1–8. As illustrated in FIG. 9, tab means 374 comprises tab portions 376, 378. Each of the tab portions 376, 378 have tab hook means 380 at opposing ends which engage the rib structure 42 and are disposed in central portion 44 of flange means 24, as disclosed in the above identified U.S. patent application Ser. No. 524,129 filed Aug. 17, 1983 by James S. Bader. Tab hook means 380 provide an interlocking connection with rib structure 42 of the clip, disclosed in FIG. 6 of the above identified application, to prevent removal of tab portions 376, 378 from the clip. Once tab portions 380 are seated in central portion 44, tab portions 376, 378 cannot be removed from the clip without tearing or ripping tab means 374. This insures that the cover means will remain in engagement with the clip during transport and normal handling of the multi-container package.

It is intended that the claims appended hereto be construed to cover alternative embodiments of the invention except insofar as limited by the prior art.

Consequently, the present invention provides an attachment to a multiple unit package.

What is claimed is:

1. An apparatus for securing and covering a group of cans comprising:

molded clip means disposed in at least one interstitial opening between end portions of a plurality of cans for securing said plurality of cans in a group, said molded clip means having a central opening suitable for insertion of a finger;

cover means coupled to said molded clip means comprising:

main body means for placement over at least part of said end portions of said group of cans;

locking tab means formed in said main body means for locking said cover means to said clip means and holding said cover means in interlocking engagement with said clip means;

fold line means for allowing said locking tab means to be displaced from said main body means and inserted in said central opening of said clip means;

resilient hinge means disposed on said locking tab means for providing resilient fold lines between a central portion and ear portions of said locking tab means which causes said ear portions to fold relative to said central portion about said resilient fold lines during insertion of said locking tab means in said central opening of said molded clip means and to resiliently outwardly expand to engage a lower surface portion of said molded clip means such that ear portions are held in an expanded position in interlocking relationship with said clip means.

2. The invention of claim 1 further comprising:

side panel means connected to said main body means by fold lines formed between said main body means and said side panels means for forming a peripheral edge of said cover means which is co-extensive with side portions of said group of cans.

3. The invention as defined in claim 1 wherein said cover means comprises a coupon.

4. The invention as defined in claim 1 wherein a portion of said cover means comprises a coupon.

5. The invention defined in claim 1 wherein said locking tab means comprises at least one pair of oppositely positioned tab portions separated by a central cut line which allows said oppositely positioned tab portions to be displaced in substantially opposite directions in said central opening of said molded clip means.

6. The invention defined in claim 1 wherein said locking tab means comprises two separate tab portions positioned for insertion in two separate molded clip means.

7. The invention defined in claim 1 further comprising:

tab hook means disposed on said locking tab means for engaging a central portion of said lower surface portion of said molded clip defined by a rib structure.

8. The invention defined in claim 5 wherein said locking tab means have a generally truncated bell-shape peripheral configuration.

9. The invention defined in claim 5 wherein said locking tab means have a generally rectangular shaped peripheral configuration.

10. The invention defined in claim 5 wherein said locking tab portions are located on opposite sides of said central opening of said molded clip means when said locking tab portions are disposed in interlocking engagement with said molded clip means.

11. A method of attaching a cover on a group of containers secured together by at least one clip device having a central opening therein comprising the steps of:

forming a group of at least four containers in a configuration providing a central interstitial space therebetween;

inserting a clip device into said central interstitial space and connecting said clip device to rim portions of each of said containers to maintain said containers in said configuration;

placing a cover member having a tab retaining means integrally formed therein on said containers with said tab retaining means aligned with said central opening in said clip device; and connecting said tab retaining means to said clip device by pushing said tab retaining means through said central opening of said clip means, folding ear portions of said tab retaining means inwardly during movement through said central opening and allowing said ear portions of said tab retaining means to resiliently outwardly expand from a central portion of said tab retaining means along resilient hinge lines formed in said tab retaining means such that said ear portions engage a lower surface portion of said molded clip means and are held in an expanded position in interlocking engagement with said clip means.

12. The method as defined in claim 11 further comprising the steps of:

providing side panel portions on the outer periphery of said cover member; and adhesively securing adjacent end portions of the side panel portions to form a continuous downwardly depending rim extending completely around the outer periphery of the group of containers.

13. The method as defined in claim 11 further comprising the step of:

providing a removable coupon which forms a portion of said cover member.

14. The method as defined in claim 11 further comprising the step of:

providing a cover member which comprises a coupon.

15. The method as defined in claim 11 and comprising:

printing information relating to the coupon on the upper surface of the cover member.

16. The method as defined in claim 12 and comprising:

printing information relating to the coupon on the upper surface of the cover member.

* * * * *